US006106358A

United States Patent [19]

McKenzie

[11] Patent Number: 6,106,358

[45] Date of Patent: Aug. 22, 2000

[54] BIBLICAL SCRIPTURE DOLL

[76] Inventor: Leila L. McKenzie, 742 Rivermist Dr., Jonesboro, Ga. 30236

[21] Appl. No.: 09/246,766

[22] Filed: Feb. 8, 1999

[51] Int. Cl.[7] ..... A63H 3/28

[52] U.S. Cl. ..... 446/299; 446/302

[58] Field of Search ..... 446/297, 299, 446/300, 301, 302, 295, 379

[56] References Cited

U.S. PATENT DOCUMENTS

| | | | |
|---|---|---|---|
| 3,298,130 | 1/1967 | Ryan . | |
| 3,421,254 | 1/1969 | Ryan et al. . | |
| 3,495,351 | 2/1970 | Bear et al. . | |
| 3,755,960 | 9/1973 | Tepper et al. | 446/299 |
| 4,207,704 | 6/1980 | Akiyama | 446/301 |
| 4,521,205 | 6/1985 | Spector . | |
| 4,585,424 | 4/1986 | DeMars | 446/295 |
| 4,737,131 | 4/1988 | Sirota | 446/295 X |
| 4,775,352 | 10/1988 | Curran et al . | |
| 5,281,180 | 1/1994 | Lam et al. | 446/302 X |
| 5,288,257 | 2/1994 | Zacherl | 446/370 |
| 5,413,516 | 5/1995 | Lam . | |
| 5,607,336 | 3/1997 | Lebensfeld et al. . | |
| 5,738,561 | 4/1998 | Pracus | 446/297 |
| 5,795,213 | 8/1998 | Goodwin . | |
| 5,820,440 | 10/1998 | Truchsess . | |

FOREIGN PATENT DOCUMENTS

| | | | |
|---|---|---|---|
| 2222093 | 2/1990 | United Kingdom | 446/302 |
| 2276329 | 9/1994 | United Kingdom | 446/302 |

*Primary Examiner*—D. Neal Muir
*Attorney, Agent, or Firm*—William B. Noll

[57] ABSTRACT

A religious doll adapted to recite biblical scriptures and biblical sayings, such as the Ten Commandments. The doll has an internal audio system including a voice chip, portable electrical power source, a speaker, and a pressure sensitive switch operable by externally applied compressive pressure against a pressure plate overlying the switch.

3 Claims, 2 Drawing Sheets

BIBLICAL SCRIPTURE DOLL

FIELD OF THE INVENTION

This invention is directed to the field of talking dolls, more particularly to a doll preprogrammed to recite biblical scriptures or teachings by the application of a compressive pressure to the, torso of the doll.

BACKGROUND OF THE INVENTION

The present invention relates to a biblical scripture speaking doll that is preprogrammed to recite biblical sayings as a "values" learning tool for children. Too often today children are exposed to TV programs, public officials and neighbors whose actions and lives do not properly convey religious values deemed so important to parents. Further, interactive games and toys are geared to commercial ventures and entertainment, with the result that parents, who wish to expose their young children to traditional religious values, while offering them a playful doll, have little from which to choose.

Talking and interactive dolls, as known in the prior art, are reflected in the following U.S. Pat. Nos:

a.) No. 5,820,440, to Truchsess, discloses a toy doll or bear that laughs or sings a nursery song when bounced or dandled. A particular area on the rump of the doll is pressure sensitive and produces the given sound when a pressure level is detected in that particular area that is within a range of pressure levels produced when the doll's rump contacts the child's knee in a gentle bounce. In an alternative embodiment, electrically conductive sensors are provided on the rump area of the doll to detect when the doll's ramp is wet. Tapping one of the bear's knees selects a respective song and controls the sound generator's mode of operation.

b.) No. 5,795,213, to Goodwin, relates to a portable toy having an audio signal producer in combination with a book The book has a plurality of numbered pages containing parts of a story. The toy is provided with a plurality of pressure switches designating different pages of the book. When a particular pressure switch is depressed, the text of the corresponding page is read aloud through a speaker provided in the toy.

c.) No. 5,738,561, to Pracas, teaches a doll having a microphone and sound recording device along with a sound playback device and a speaker. The doll is provided with contacts or buttons to activate the sound recording device and the sound playback device. A child may speak to the doll and record messages, which may be played back at a later time.

d.) No. 5,607,336, to Lebensfeld et al., discloses a uniquely constructed message delivering doll or action figure, which is capable of providing, when activated, words or phrases specifically relating to one desired, precise subject, activity, profession or area of interest for which the doll or action figure is dressed. This is accomplished with a toy doll or action figure which incorporates an audio generator contained therein for producing audible messages, message containing components removably interconnectable therewith, and outfits of wearing apparel for designating or relating to one specific subject, activity, profession, or area of interest.

e.) No. 5,413,516, to Lam, relates to a toy doll with lips that move as speech sounds are produced from a speaker. Pressing a button on the body of the doll activates an integrated circuit that sends voice signals to the speaker, which transmits the sounds. This in turn actuates a switch, causing a motor to run. The drive shaft of the motor rotates, causing a series of meshing gears to turn. The axle of a gear in the series that passes through the eccentric bore of an internal cam causes the cam to move so that it forces an L-shaped cam follower to rock back and forth about a pivot point. The rotatable pivot rod is supported by the rigid torso of the doll, and one end of the cam follower is attached to the interior of the doll's flexible face at a point connecting the two lips. The rocking of the cam follower causes the lips to close and open in a simultation of talking. The motor only runs, and consequently the lips only move, at the same time that simulated speech is transmitted from the speaker. A portion of the doll's rigid body that is interior to its flexible head supports the head and prevents the head and face from collapsing or becoming distorted during operation.

f.) No. 4,775,352, to Curran et al., teaches an animated audio doll whose mouth can be driven by replaceable tape cartridges. The doll has a head member with simulated eyes and mouth that can open and close. Uni-directional direct current motors are provided in the body of the doll and are connected to the respective eyes and mouth through flexible driven links that protect the motor if either the eyes or the mouth are held stationary. The tape cartridge can be encoded with audio signals, a base frequency and a pair of coordinated frequency timing signals. The tape player can convert the frequency timing signals into digital signal levels while a binary switch member can determine when the mouth is in a closed position. A level detector circuit can determine whether the first or second timing signals are present and a logic circuit can, in combination with the timing signals and the output from the binary swith, drive the DC motor connected to the mouth in coordination with the audio sounds.

While the respective dolls or animated Figures of the prior art disclose some form of a talking doll, none are directed specifically to the combination of a talking doll that recites biblical scriptures or teachings, especially where such recitations are in a child's voice. The manner by which the doll of the present invention may be used as a teaching support of religious principles will become more apparent to those skilled in the art from the following description.

SUMMARY OF THE INVENTION

This invention relates to a biblical scripture speaking doll adapted to recite preprogrammed biblical scriptures, and teachings. The doll comprises a torso portion formed of a soft open cell foam, plural appendages attached thereto and simulating a pair of legs, a pair of arms, and a baby's head. The torso portion is defied by a front and a back to simulate, respectively, the front and back of a baby, where the torso back includes a central recess mounting a voice chip and battery holder, containing a battery. The battery holder includes a pressure sensitive switch extending therefrom and positioned with a flexible bellows section. The flexible bellows section further includes a pressure plate for selectively activating the pressure sensitive switch. Included further is a speaker mounted in the soft open cell foam in electrical communication with the battery, the voice chip and the pressure sensitive switch. Finally, a cloth skin is provided to the torso portion and appendages, where the cloth skin has a simulated heart aligned to overlie the pressure plate, whereby application of a compressive force to the simulated heart forces the pressure plate against the pressure sensitive switch to activate a preprogrammed biblical scripture or teaching from the voice chip.

Accordingly, an object of this invention is the provision of a religious learning and values teaching tool for a child, while giving the child a bedtime companion.

Another object hereof is a doll that can help to encourage a child to learn and understand religious values in a friendly and family environment.

These and other objects will become apparent in the following specification, particularly when read in conjunction with the accompanying drawings.

DETAILED DESCRIPTION OF PREFERRED EMBODIMENT

Figure 1B:
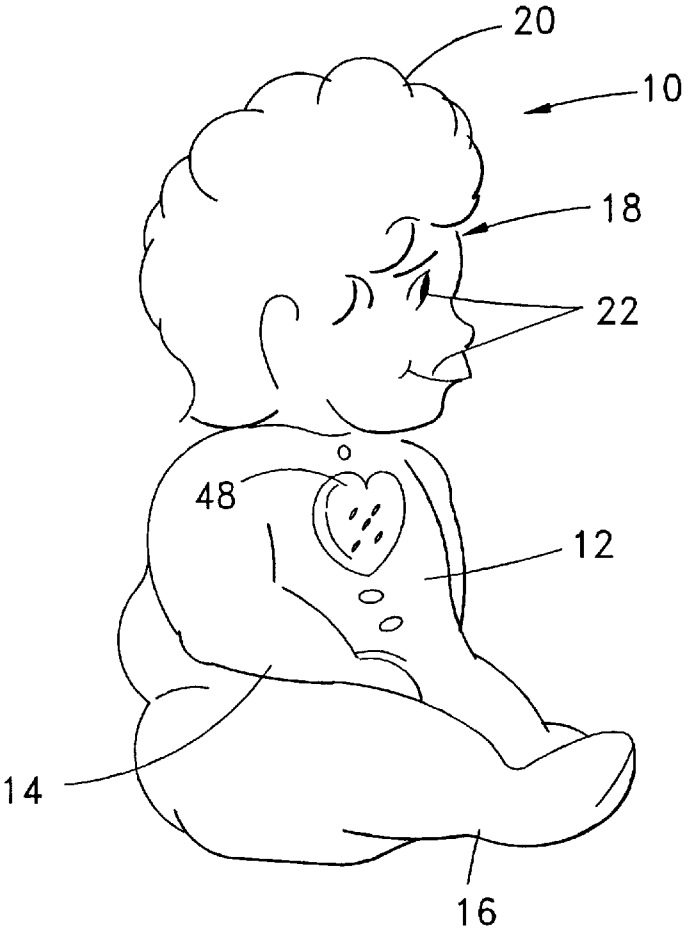
FIGS. 1A and 1B, respectively, are front and side views of a religious speaking doll incorporating the unique features of this invention.

The present invention is directed to a religious doll that may be activated by a child, where the doll, when activated, recites biblical scriptures or biblical teachings. Such invention will now be described with reference to the several Figures, where like reference numerals represent like components or features throughout the several views.

Figure 1A:
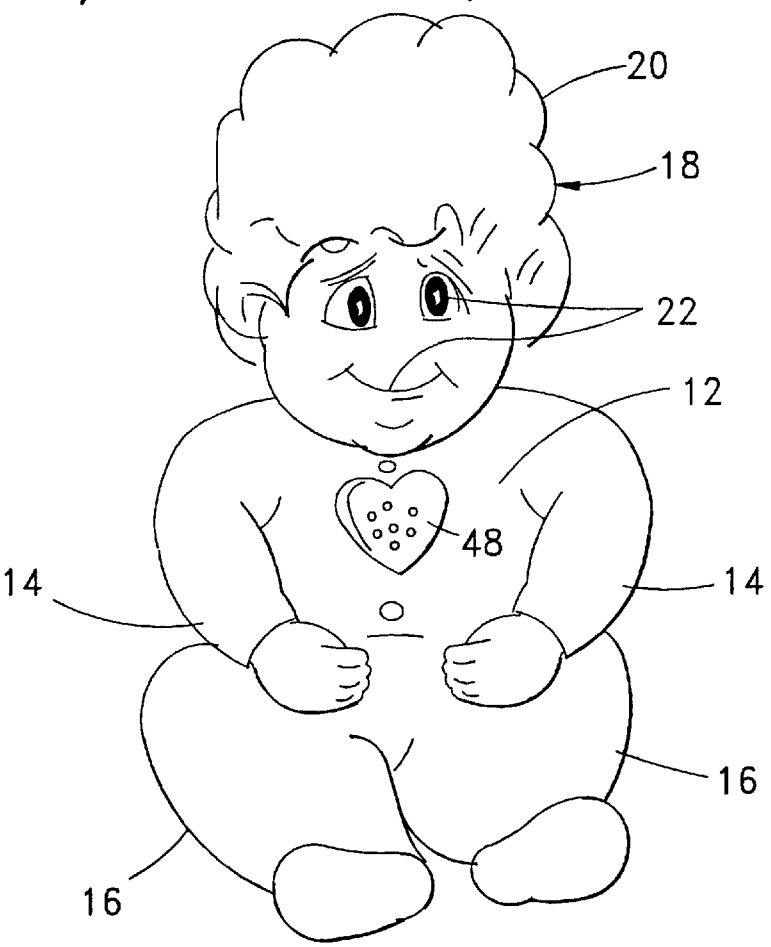

The doll 10 of this invention, as exemplified externally, is illustrated in FIGS. 1A and 1B. The exemplary doll 10 comprises a torso portion 12 and plural appendages in the form of a pair of arms 14, a pair of legs 16, and a head 18, where the head further features simulated hair 20 and facial features 22.

Figure 4:
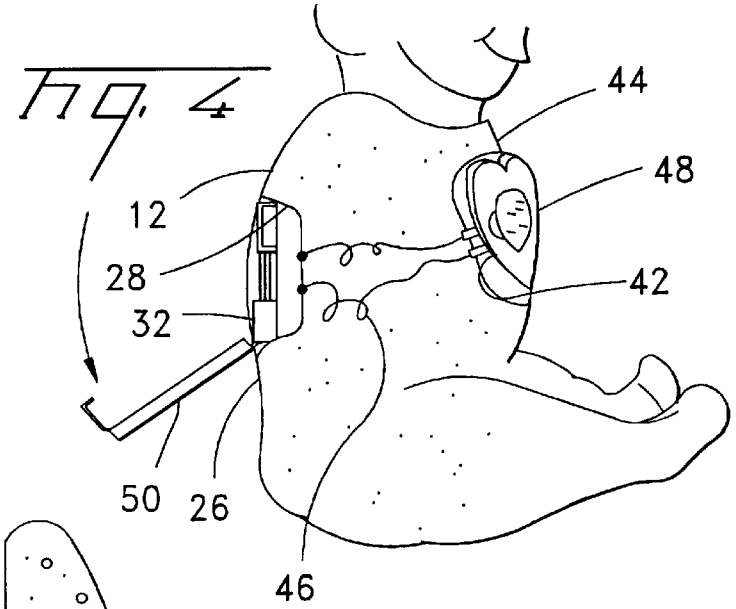
FIG. 4 is a partial sectional view of the doll of this invention, illustrating details for activating the religious sayings recited by the doll hereof.
Figure 3:
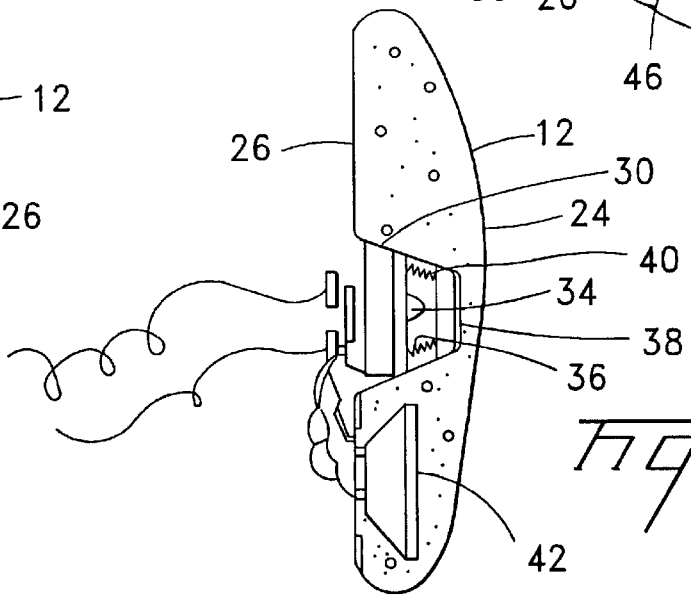
FIG. 3 is a partial sectional view taken vertically through the torso of the doll hereof, showing flirter certain internal details.
Figure 2:
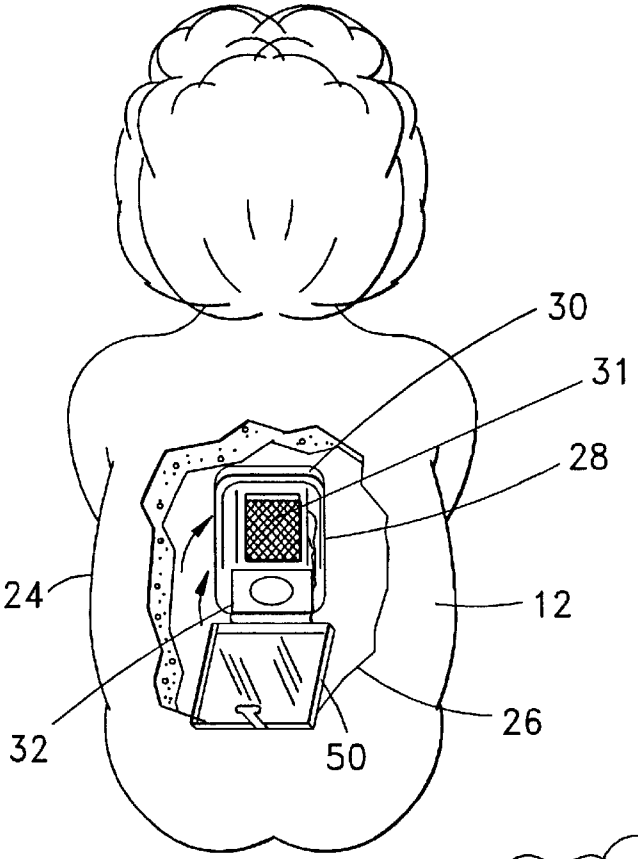
FIG. 2 is a back view, with parts removed, to illustrate certain internal details of the religious doll according to the present invention.

FIGS. 2–4 illustrate details of the biblical recitation system of this invention, where such system is contained internally of the torso portion 12. The torso portion 12 comprises a torso shaped member 24 preferably formed of a soft open cell foam, as known in the art, that may be readily compressed by a child. The torso shaped member 24, along the back 26 of the doll 10, includes a central recess 28 containing a battery housing 30, a replaceable voice chip 31 containing selected biblical sayings, and a portable electrical source 32, such as in the form of a 9-volt battery. Additionally, an inwardly directed pressure sensitive switch 34 is provided, where the switch 34 is surrounded on the sides by a continuous, flexible bellows member 36, the bellows member being formed of plastic and characterized by a shape memory that restores its shape where pressure is released. To facilitate depression of the switch 34, an overriding pressure plate 38, preferably circular in shape, is provided along one continuous edge 40 of the bellows member 36. That is, when compressive pressure is applied to the pressure plate 38, the pressure plate acts against the switch to activate the voice chip 31. Further, in order to hear the biblical sayings, a speaker 42 is provided. While placement of the speaker can vary within the torso portion 12, a preferred position is centrally of the torso front 44 aligned with the pressure plate 38. Finally, to electrically connect the various components, to audibly activate the voice chip, appropriate electrical circuitry 46 is provided.

To simulate and contain the torso portion and related appendages, a cloth skin may be provided about the various body parts. Further, since the doll of this invention is directed to small children, a simulated heart 48 may be provided along the torso front 44, aligned with the pressure plate 38 and preferred position for the speaker 42 as the prime compression point for activating the audio system hereof.

Finally, since the electrical source is a battery, which typically will have to be replaced, a hinged access door 50 may be provided to overlie the central recess 28.

It is recognized that variations, modifications, and changes may be made to the doll of this invention, such as in the nature of tie internal support for the respective appendages. Specifically, the support may be in the form of a soft foam, or cloth pieces. Accordingly, no limitation is intended to be imposed on the doll hereof, except as set forth in the accompanying claims.

What is claimed is:

1. A biblical scripture speaking doll adapted to recite preprogrammed biblical scriptures, said doll comprising:

a.) a torso portion formed of a soft open cell foam, plural appendages attached thereto and simulating a pair of legs, a pair of arms, and a baby's head;

i) said torso portion being defined by a front and a back to simulate, respectively, the front and back of a baby, where said torso back includes a central recess mounting a voice chip and battery holder containing a battery, said battery holder including a pressure sensitive switch extending therefrom and positioned within a flexible bellows section, said flexible bellows section further including a pressure plate for selectively activating said pressure sensitive switch, ii.) a speaker mounted in said soft open cell foam in electrical communication with said battery, said voice chip and said pressure sensitive switch; and b.) a cloth skin covering said torso and appendages, said cloth skin having a simulated heart aligned to overlie said pressure plate, whereby application of a compressive force to said simulated heart forces said pressure plate against said pressure sensitive switch to activate a preprogrammed biblical scripture from said voice chip.

2. The biblical scripture speaking doll according to claim 1, wherein said speaker underlies said simulated heart.

3. The biblical scripture speaking doll according to claim 1, wherein access means are provided for externally replacing said battery.

* * * * *